US008985367B2

(12) United States Patent
Kim et al.

(10) Patent No.: US 8,985,367 B2
(45) Date of Patent: Mar. 24, 2015

(54) HAIR DYE MIXING ASSEMBLY

(71) Applicants: Chan Soo Kim, Seongbuk-ku (KR); Saerom Kim, Seongbuk-ku (KR); Bumjin Kim, Seongbuk-ku (KR)

(72) Inventors: Chan Soo Kim, Seongbuk-ku (KR); Saerom Kim, Seongbuk-ku (KR); Bumjin Kim, Seongbuk-ku (KR)

( * ) Notice: Subject to any disclaimer, the term of this patent is extended or adjusted under 35 U.S.C. 154(b) by 179 days.

(21) Appl. No.: 13/633,715

(22) Filed: Oct. 2, 2012

(65) Prior Publication Data

US 2014/0090992 A1 Apr. 3, 2014

(51) Int. Cl.

| | |
|---|---|
| ***B65D 21/02*** | (2006.01) |
| ***A45D 19/00*** | (2006.01) |
| ***A45D 34/00*** | (2006.01) |

(52) U.S. Cl.

CPC ..... *A45D 19/00* (2013.01); *A45D 19/0008* (2013.01); *A45D 34/00* (2013.01); *A45D 2200/058* (2013.01)

USPC ..... 220/23.83; 220/23.8; 206/581

(58) Field of Classification Search

USPC ..... 206/219, 581; 220/23.8, 23.83, 23.86, 220/23.4, 23.2

See application file for complete search history.

(56) References Cited

U.S. PATENT DOCUMENTS

| | | | | |
|---|---|---|---|---|
| 3,139,208 | A * | 6/1964 | Irwin et al. | 220/23.8 |
| 5,259,528 | A * | 11/1993 | Pace et al. | 220/575 |
| 5,624,052 | A * | 4/1997 | Caldi | 220/575 |
| 6,520,366 | B1 * | 2/2003 | Bradley et al. | 220/23.2 |

* cited by examiner

*Primary Examiner* — David Fidei
(74) *Attorney, Agent, or Firm* — Trojan Law Offices

(57) ABSTRACT

A hair dye mixing assembly comprises a bowl comprising at least one arm and an opening and at least one support member arranged about said bowl, and attached to the bowl through the bowl arm. The support members can be immovably fixed to the bowl, movably connected to the bowl to move or rotate in different directions, or a combination thereof.

12 Claims, 15 Drawing Sheets

HAIR DYE MIXING ASSEMBLY

CROSS-REFERENCE TO RELATED APPLICATIONS

None.

COPYRIGHT

A portion of the disclosure of this patent document contains material to which a claim for copyright is made. The copyright owner has no objection to the facsimile reproduction by anyone of the patent document or the patent disclosure, as it appears in the Patent and Trademark Office patent file or records, but reserves all other copyright rights whatsoever.

FIELD OF INVENTION

The present disclosure relates to containers and more particularly to bowls used in hair dye preparation.

DESCRIPTION

A common technique for preparing hair dye is via mixing the dye ingredients in a bowl. For example, first and second hair dyes are typically mixed in a bowl with a brush. However the bowl moves around and up/down due to the forces required for mixing. The result is often an unstable bowl position, relatively slow working process and an inconsistent hair dye on the brush. The present embodiments address the aforementioned issues where a hair dye mixing assembly comprises at least one support member.

SUMMARY

In one embodiment, a hair dye mixing assembly comprises (1) a bowl comprising at least one arm and (2) at least one support member arranged about said bowl. The support member(s) can be substantially tubular and comprise a top portion, a bottom portion, and a first opening defined by said top portion. The bowl is attached to the support member(s) through one of said arms. In a sub-embodiment, the central longitudinal axis of the support member(s) and central axis of said bowl are substantially parallel.

In another embodiment, a hair dye bowl assembly comprises (1) a bowl comprising at least one arm, and (2) at least one support member arranged about said bowl. The support member(s) can be substantially tubular and comprise a top portion, a bottom portion, a first opening defined by said top portion and a support member arm.

In one embodiment, at least one support member is immovably connected to the bowl. In another embodiment, at least one support member is movably connected to the bowl arm. The support member may slide, rotate or otherwise change position with respect to the bowl arm. In one embodiment, at least one support member can rotate toward or away from the bowl. In another embodiment, at least one support member can rotate about a radial axis of said bowl. In yet another embodiment at least one support member arm can slide towards and away from the bowl.

DETAILED DESCRIPTION OF THE EMBODIMENTS

Figure 1:
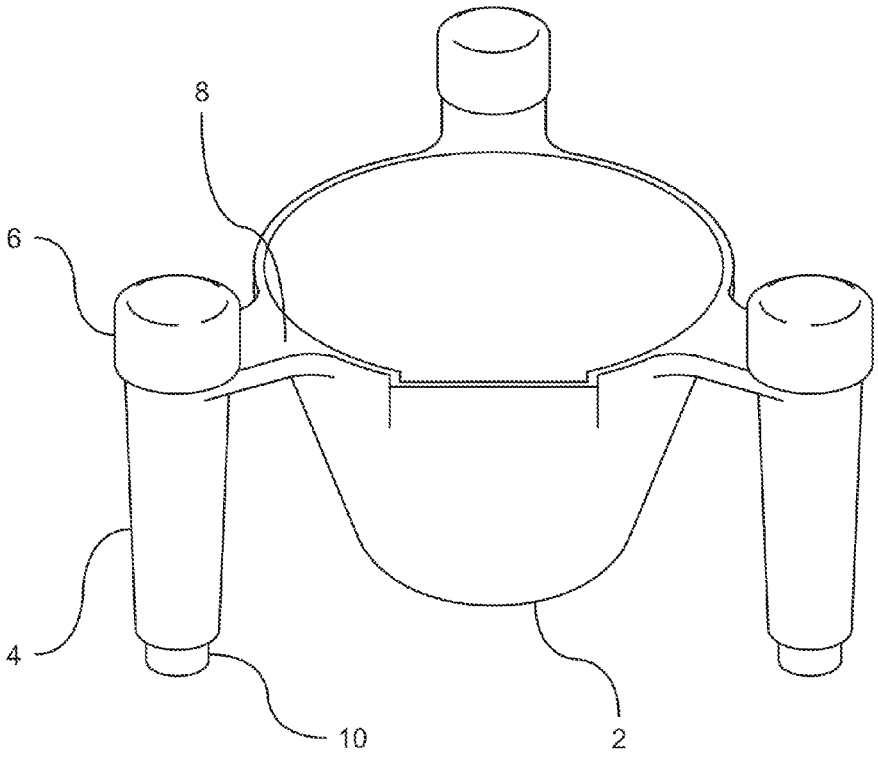
FIG. 1 is a perspective view of an embodiment with three support members immovably fixed to the bowl.

The present embodiments describe a hair dye mixing bowl assembly with features for improved stability, efficient mixing time and more consistent dye content on each brush. At least one support member connected to the bowl yields additional stability. Providing more than one support member allows the assembly to rest on a surface while the bowl itself is suspended above the surface. With this arrangement, forces involved in mixing do not violently shake the mixing bowl and disrupt the process. In some embodiments, one or more support members may move with respect to, or detach from the bowl to improve positioning or save space. Further, each support member may or may not house solid/liquid content such as hair dye ingredients.

The bowl itself can have any dimension suitable for receiving an amount of ingredients typically required to prepare a hair dye mixture. Further, it may have additional features for disposing liquid content, such as but not limited to, a spout. Even further, it may have additional features for cleaning tools such as serration for cleaning the brush. Finally, the bowl may be made of any material that will not negatively react with dye ingredients or otherwise impede its purpose.

In one embodiment, the hair dye bowl assembly comprises:
(1) a bowl comprising at least one arm; and
(2) at least one support member arranged about said bowl, the support member(s) being substantially tubular and comprising a top portion, a bottom portion, and a first opening defined by said top portion.

In some embodiments, the hair dye mixing assembly has two support members. In the preferred embodiments, the assembly has three support members. However, additional support members are contemplated in the present embodiments, particularly if such added features provide additional aesthetic, mechanical, or other functional benefits for the desired task. For instance, additional support members may be desirable for uneven surfaces. Also, a plurality of support members can house a wide variety of ingredients for mixing, as well as housing for different tools.

The support member is attached to the bowl through the bowl arm. In some embodiments the support member itself also comprises an arm where the support member arm is connected to the bowl arm. In other embodiments, the support member does not have an arm.

In some embodiments, at least one support member is immovably fixed to the bowl. Preferably, in such embodiments, the support member is connected to the bowl arm without a support member arm. In some cases, it may be aesthetically and/or functionally desirable to have the bowl and the support members in a parallel arrangement. That is, the bowl is fixed to the support member such that the central longitudinal axis of said support members and central axis of said bowl are substantially parallel. In some cases it may be desirable to have the support members slanted with respect to the bowl such that central longitudinal axis of said support members and central axis of said bowl are clearly not parallel.

Figure 2:
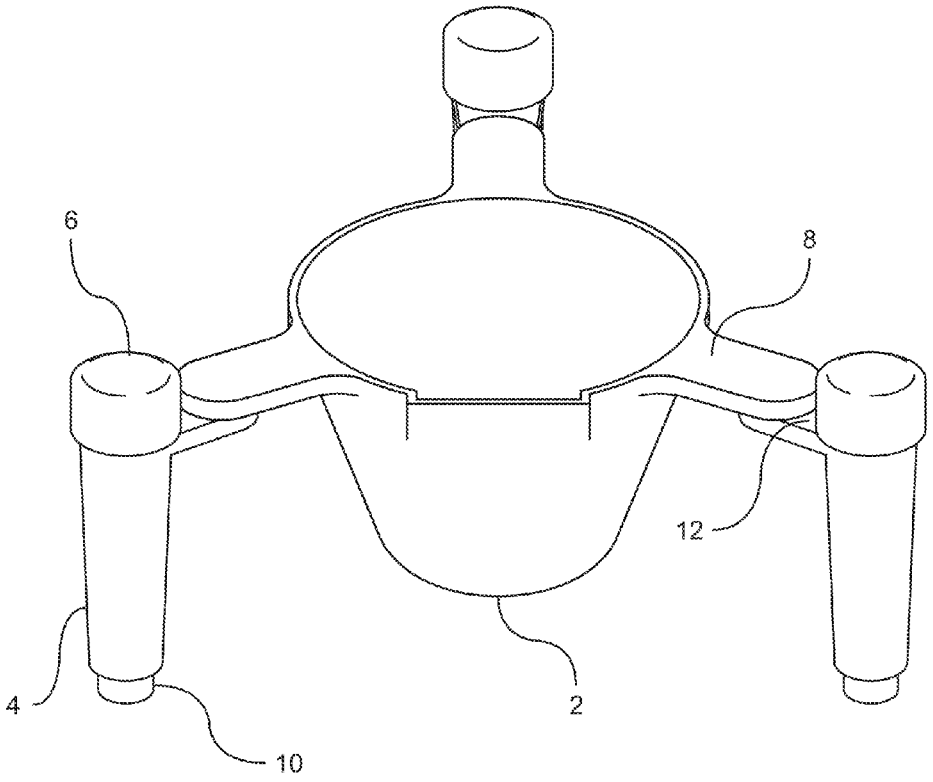
FIG. 2 is a perspective view of an embodiment with three support members moveably connected to the bowl.
Figure 3:
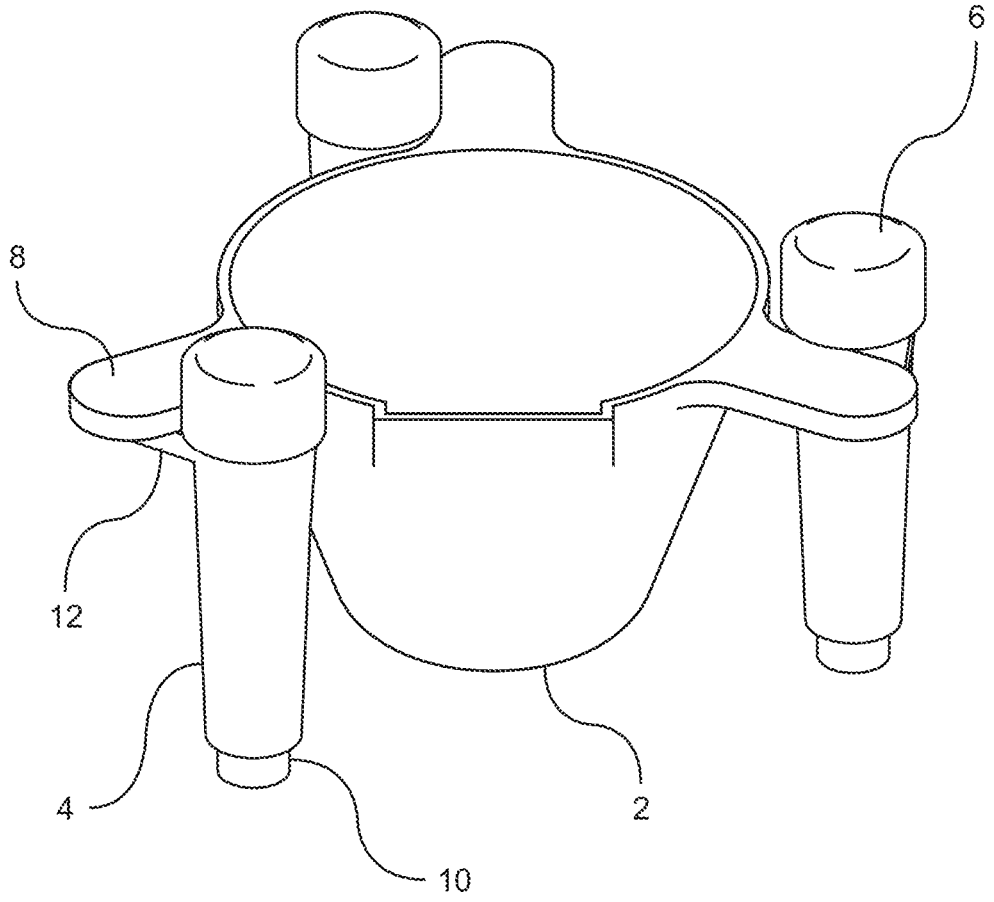
FIG. 3 is another perspective view of an embodiment with three support members moveably connected to the bowl.

In some embodiments, at least one support member is moveably connected to the bowl. That is, the support member can change position/configuration with respect to the bowl. In these embodiments the support member preferably comprises an arm. In one embodiment, the support member can rotate toward or away from the bowl through a pivot point located between bowl and the support member (as shown in FIGS. 2 and 3). This can reduce the space required for the assembly, for example when in storage or when working on a limited available surface.

In another embodiment, the support member can rotate about a radial axis of said bowl. In other words, the support member can rotate 360 degrees, while the bowl is stationary. Likewise, this arrangement allows configuration changes for managing storage of the assembly, or mixing contents in each support member.

In yet another embodiment, the support member can slide towards or away from the bowl using a sliding mechanism. In such embodiment, preferably at least one support member arm is received in sliding engagement by a slot defined by a bowl arm. Again, this can be advantageous for uneven surfaces as well as for reducing the space required for storage or working.

As already mentioned, the added stability from the support member(s) is a useful feature. Preferably, more than one support member contacts the surface on which the hair dye mixing assembly rests, with the bowl suspended above the surface (e.g. FIG. 7). Thus, in the preferred embodiments, the support members are substantially taller than the bowl. Moreover, for added stability, the support member(s) can comprise a traction pad connected to their bottom portion which contacts the surface on which the assembly rests on. The traction pad(s) provide additional friction preventing the assembly from translating horizontally while the content in the bowl is mixed. The traction pad may be the floor-facing side a stopper inserted into a hole on the bottom portion of the support member.

It may be desirable for the support member(s) to maintain content in such a way as to avoid spills or prolonged exposure to the ambient causing dehydration or degradation. To that end, each support member preferably comprises a cap to cover the opening to the reservoir in each support member. Alternatively, the support member may store heavy content to as to weigh the entire assembly down and provide added stability. Any content, whether solid or liquid, that can properly weigh down the support member may be stored therein. Moreover, in one embodiment, at least one cap comprises a hole to receive a tool such as a hair brush. Thus, not only does the support member(s) house content, the tool placed through the cap may also rest inside the support member. Caps are widely known and may be a screw or a stopper type. The cap may be connected to the support member so that it is not misplaced or lost.

The present embodiments are further explained in view of the following figures, and descriptions thereof, which are not intended to limit the scope of the embodiments in any manner.

In the mixing bowl assembly illustrated in FIG. 1, the bowl 2, is connected to three support members 4 via bowl arm 8. Each support member has a cap 6 and a traction pad 10. The support members 4 are immovably fixed to the bowl 2.

In the assembly of FIG. 2, the bowl 2, is connected to three support members 4 via bowl arm 8 and support member arm 12. Each support member has a cap 6 and a traction pad 10. The support members 4 are movably connected to the bowl 2 with the freedom to pivot side to side in an arc path.

The assembly of FIG. 3 is the same embodiment as that of FIG. 2, further illustrating how the support members 4 can pivot towards the bowl 2.

Figure 4:
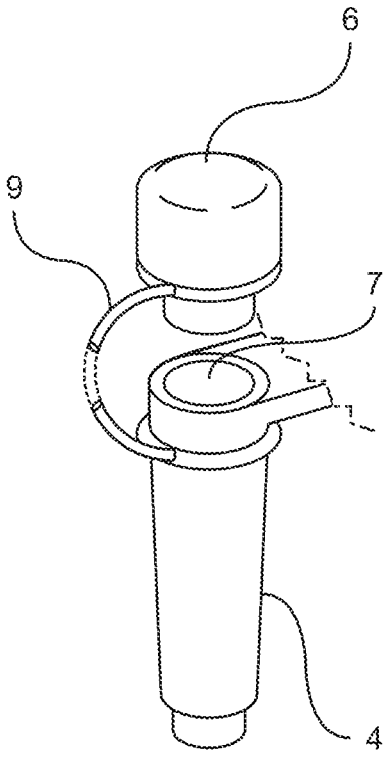
FIG. 4 is a perspective view of one type of cap for a support member.
Figure 5:
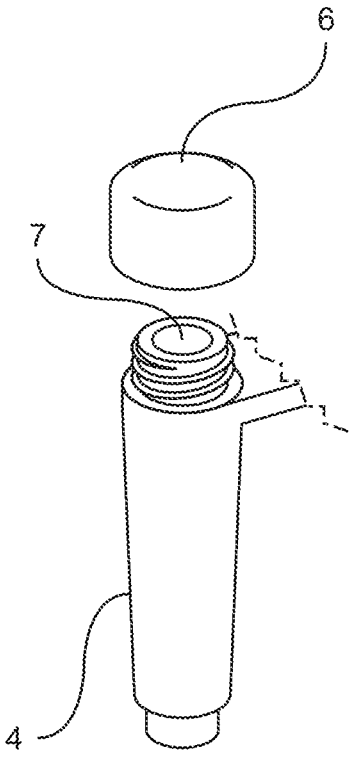
FIG. 5 is a perspective view of another type of cap for a support member.

Examples of the types of caps available are illustrated in FIGS. 4 and 5. In FIG. 4, the support member 4, has an opening 7, defined by the top portion of said support member. The opening is covered (or plugged) with a cap 6 that comprises a stopper. The cap 6 is further attached to the support member 4 via a connector 9. In FIG. 5, the opening 7 of the support member 4 is covered with a cap 6 that screws onto the support member 4.

Figure 6:
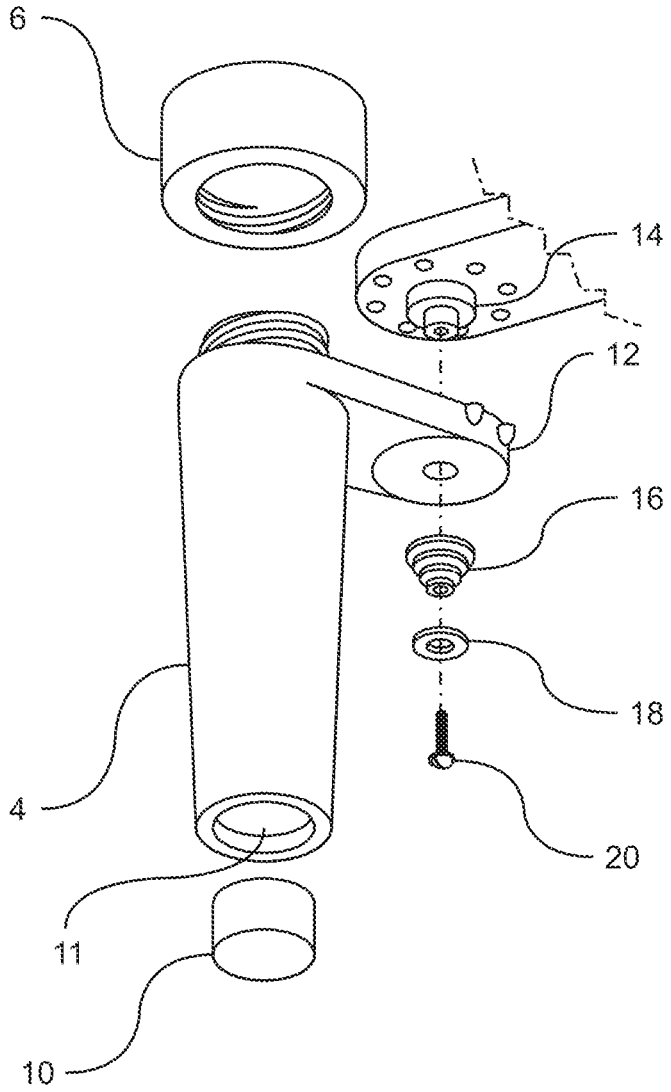
FIG. 6 is an exploded view of the components for a support member moveably connected to the bowl, according to an embodiment.

FIG. 6 provides the details for the support member/bowl connectivity per embodiments resembling (but not necessarily the same as) the assembly of FIGS. 2 and 3 where the support member(s) 4 can pivot side to side. As illustrated, the pivot member 14 protrudes from the bowl arm and penetrates a hole defined by a portion of the support member arm 12. The pivot member 14 is secured with a spring 16, a washer 18 and a pin 20 (or bolt.) A traction pad 10 is also partially inserted into a hole defined by the lower portion of the support member 4. The opening in the top portion (not shown) is covered with a screw cap 6.

Figure 7:
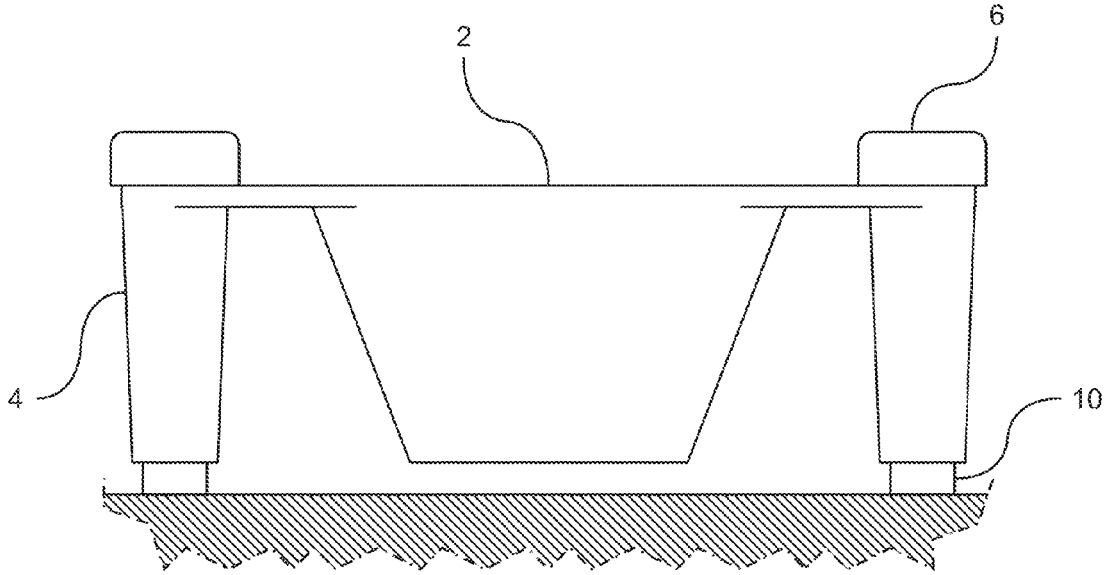
FIG. 7 is a cross-sectional view according to an embodiment showing the support members resting on a surface.

The cross-sectional view provided in FIG. 7 is that of an assembly resting on a surface such that the support member(s) 4 are in contact with the surface via the traction pad(s) 10 and the bowl 2 is suspended above the surface.

Each support member 4 has a cap 6 as well.

Figure 8:
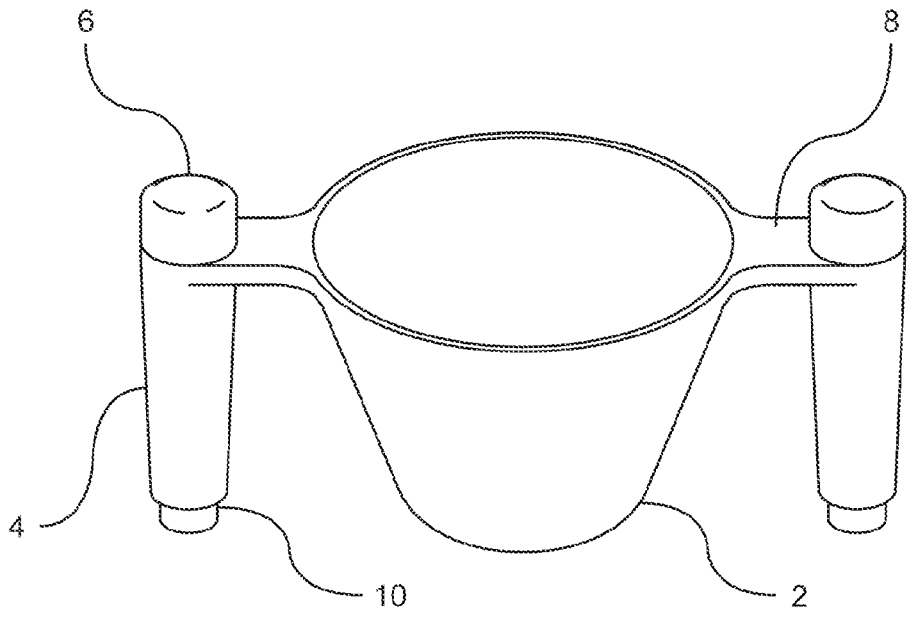
FIG. 8 is a perspective view according to an embodiment with two support members immovably fixed to the bowl.
Figure 9:
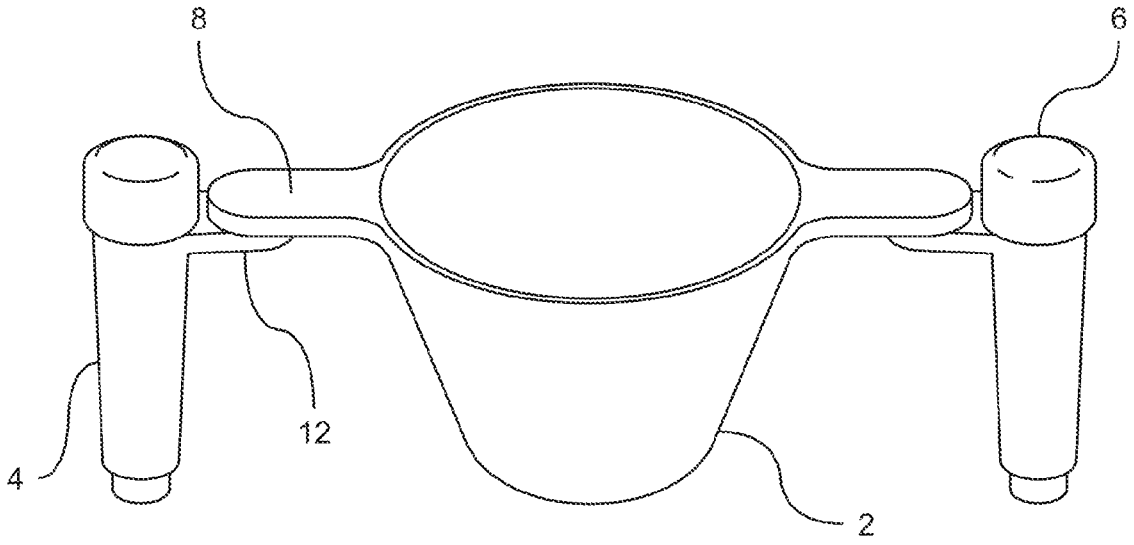
FIG. 9 is a perspective view according to an embodiment with two support members movably connected to the bowl.

FIGS. 8 and 9 illustrate embodiments where the hair dye bowl assembly has two support members. In FIG. 8, both support members 4 are immovably fixed to the bowl arm 8, have a cap 6 as well as a traction pad 10. In contrast, the support members 4 of FIG. 9 are movably connected to the bowl 2, through the bowl arm 8 and the support member arm 12. Also here the support members 4 have caps 6.

Figure 10:
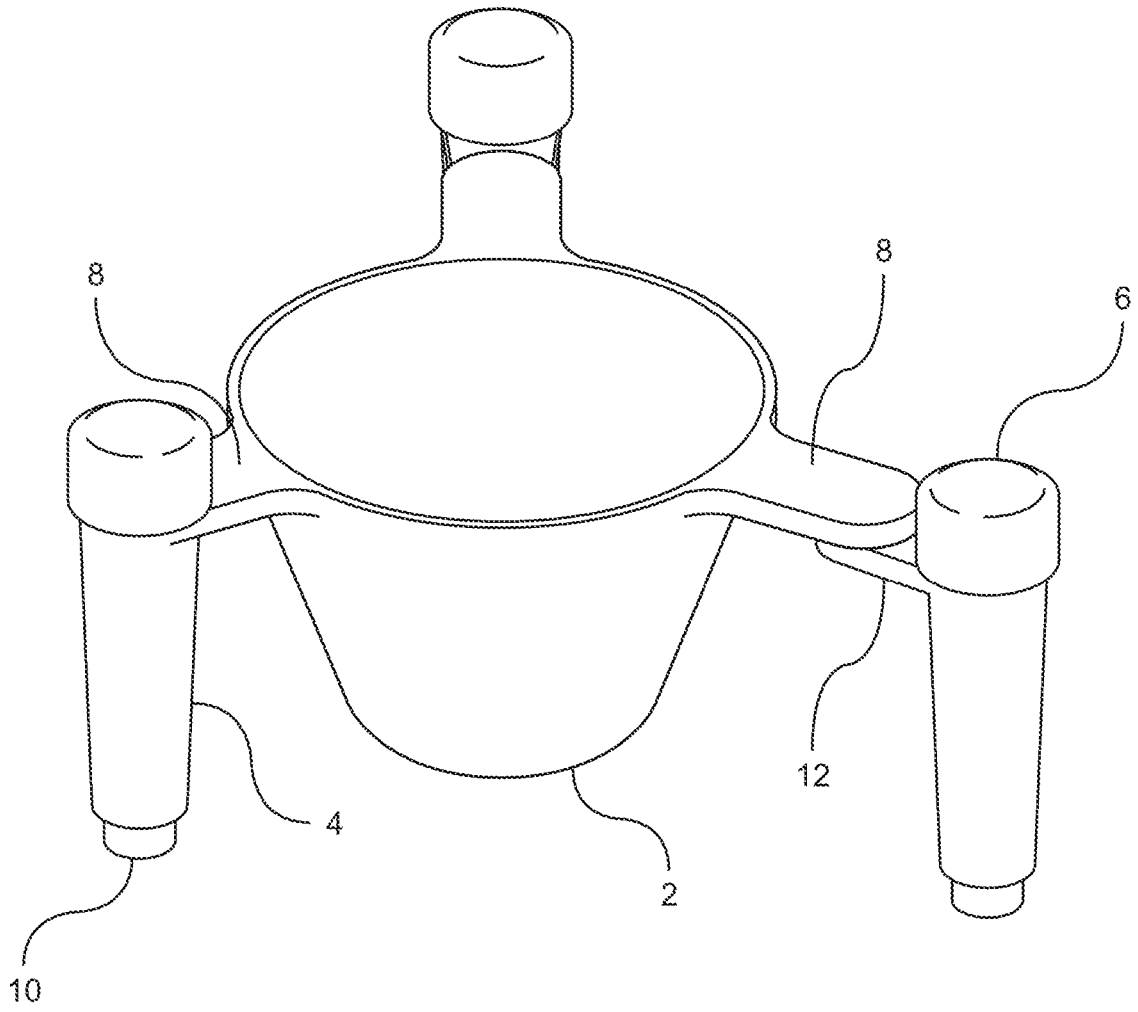
FIG. 10 is a perspective view according to an embodiment with two support members movably connected to the bowl and one support member immovably fixed.

The hybrid assembly of FIG. 10 shows an assembly with two support members 4 that are movably connected to the bowl 2, and one that is immovably fixed thereto. In this particular example, the immovable support member 4 is fixed directly to the bowl arm 8, whereas the movable support members 4 have an arm 12 that connects to the bowl arm 8. All support members have a traction pad 10 and a cap 6.

Figure 11A:
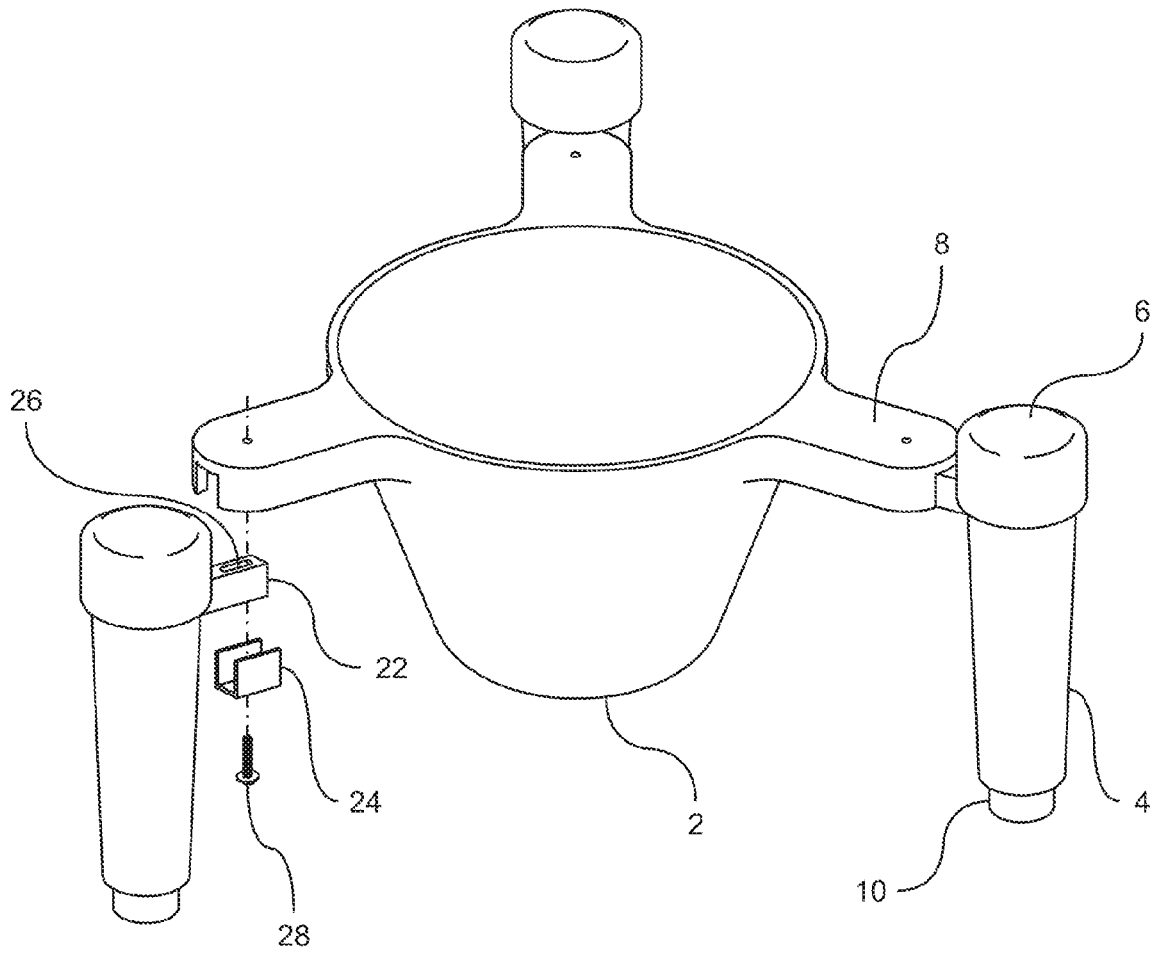
FIG. 11*a* is a perspective view showing an embodiment with the support members received in sliding engagement with the bowl arm along with the components for such mechanism.
Figure 11B:
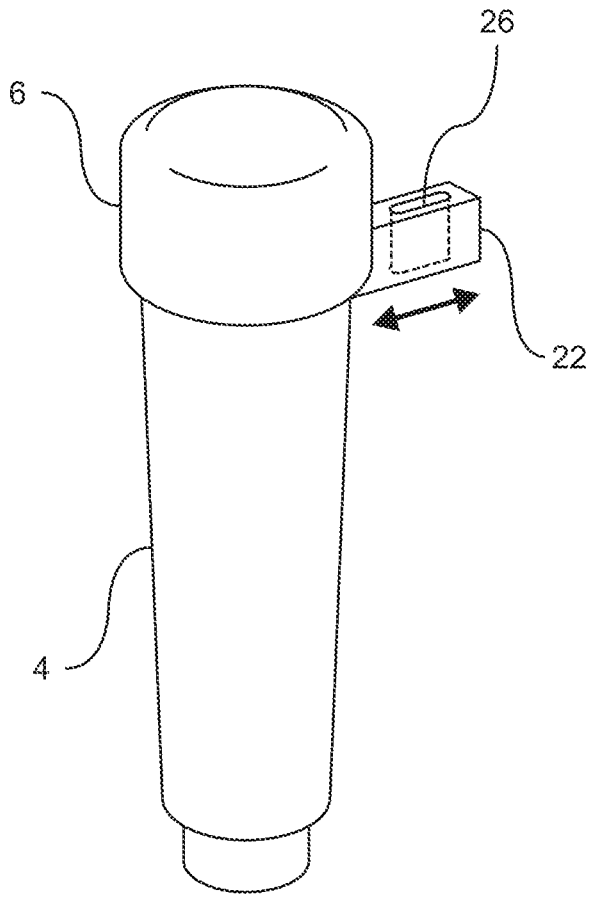
FIG. 11*b* is an enlarged view of the arm member according to the embodiment shown in FIG. 11*a*.

The assembly of FIG. 11*a*, is another instance where the support members are movable. Here, each support member 4 has a modified arm 22 which can slide in and out of the bowl arm 8. FIG. 11*b* provides an enlarged view of this arm member 4. The bowl arm 8 has an opening that is adapted to receive the sliding support 24 as well as the support member modified arm 22. The support member 4, can be fixed in place with a pin 28 (or bolt/screw) that penetrates the hole (not shown) through the sliding member 24 the hole 26 through the modified support member arm 22, and the hole in bowl arm 8. The pin (or bolt/screw) is preferably secured with a rivet (or nut, etc.) or other fastening mechanism that is appropriate. Again each support member 4 has a traction pad 10 and a cap 6.

Figure 12:
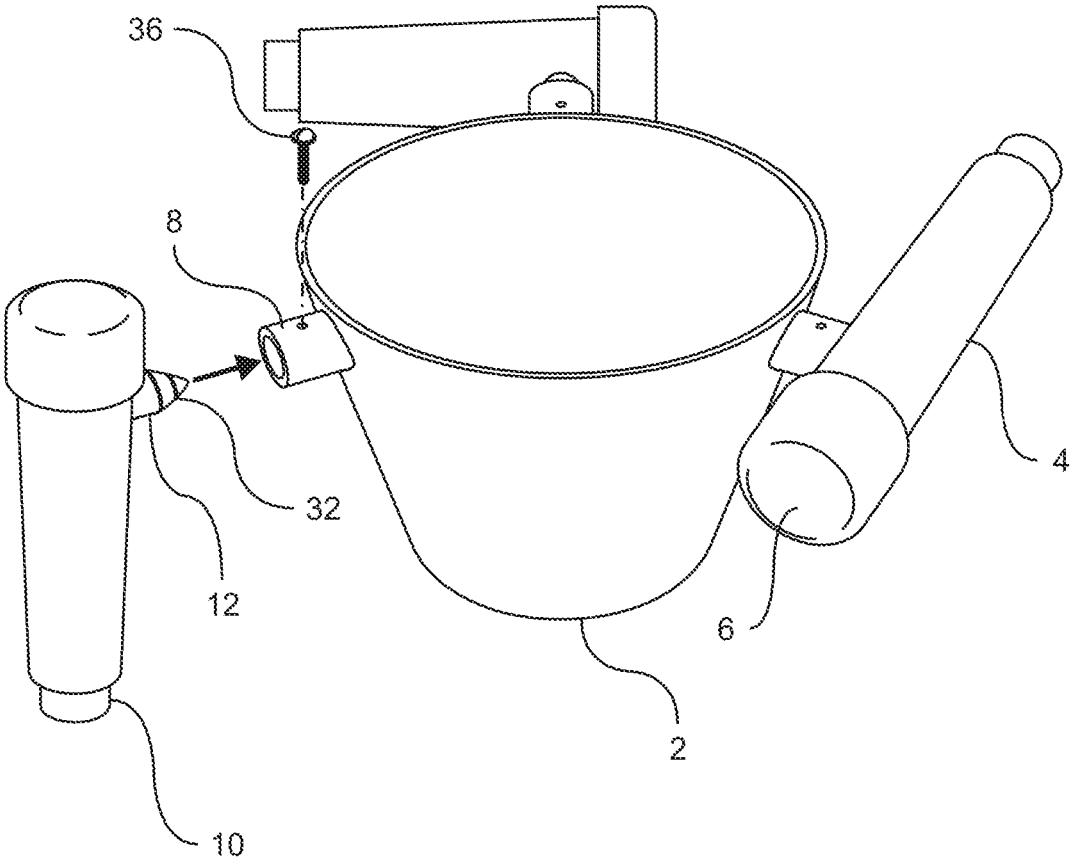
FIG. 12 is a perspective view showing an embodiment with the support members moveably connected to the bowl.

As another example of an assembly with movable support members, FIG. 12 illustrates support members 4 that can rotate about a radial axis of the bowl 2. In this Figure, the support member arm 12 has a furrower 32 at the tip portion which inserts into the bowl arm 8 which has an opening adapted to receive the furrower 32. The support members 4 can fully rotate but may also be fixed in place with a pin 36 (or screw/bolt) that penetrates the bowl arm 8 and contacts the support member arm 12. As shown, all support members 4 have a cap 6, traction pad 10, and are rotated pointing toward different planes.

Figure 13:
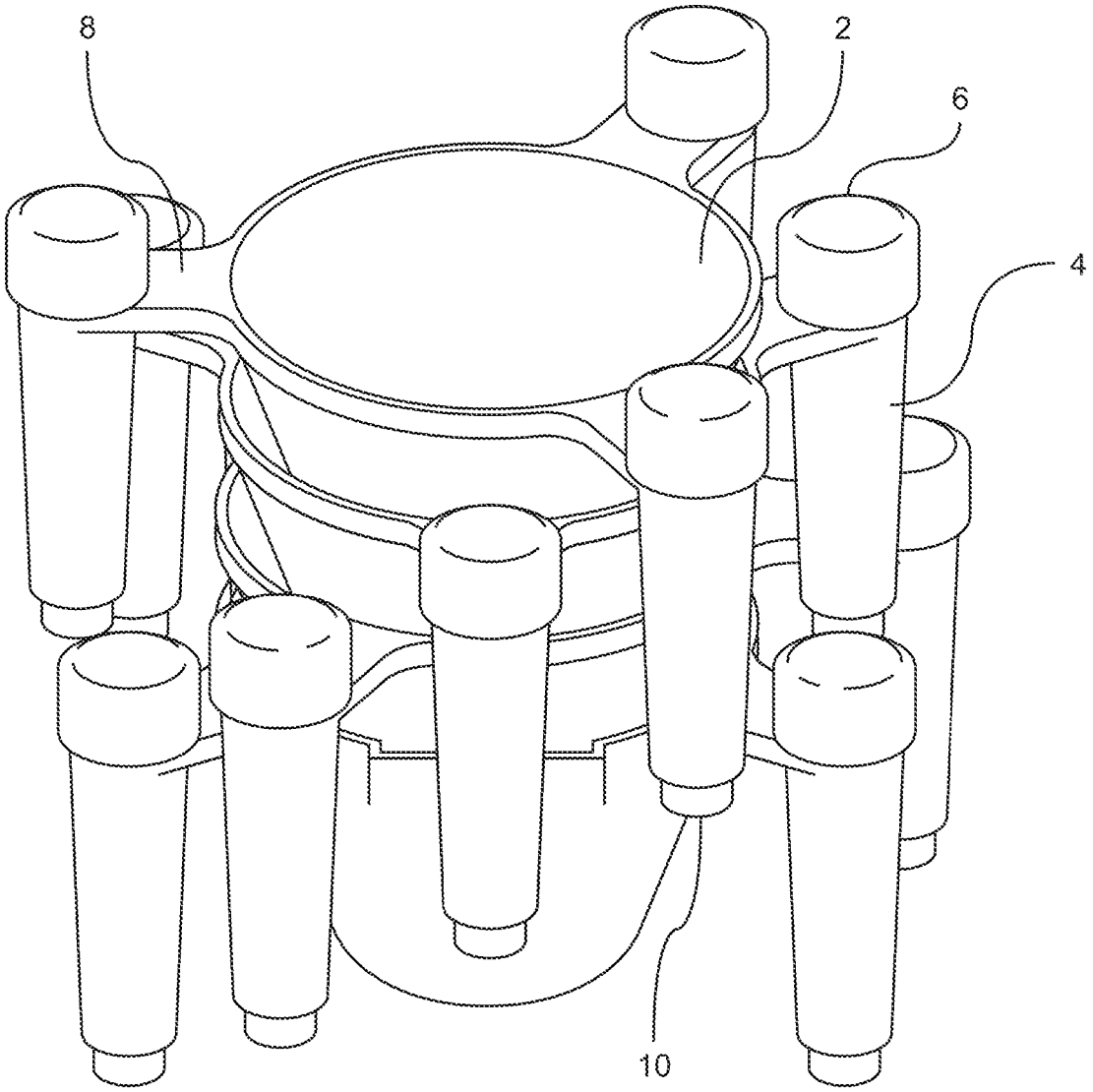
FIG. 13 is a perspective view of four hair dye bowls stacked on top of each other, according to an embodiment.

The assemblies can be designed to save space when stored together. FIG. 13 provides an example where four assemblies, each with three immovable support members 4, are easily stacked on top of each other. The bowls 2 this example fit in each other to save space.

Figure 14:
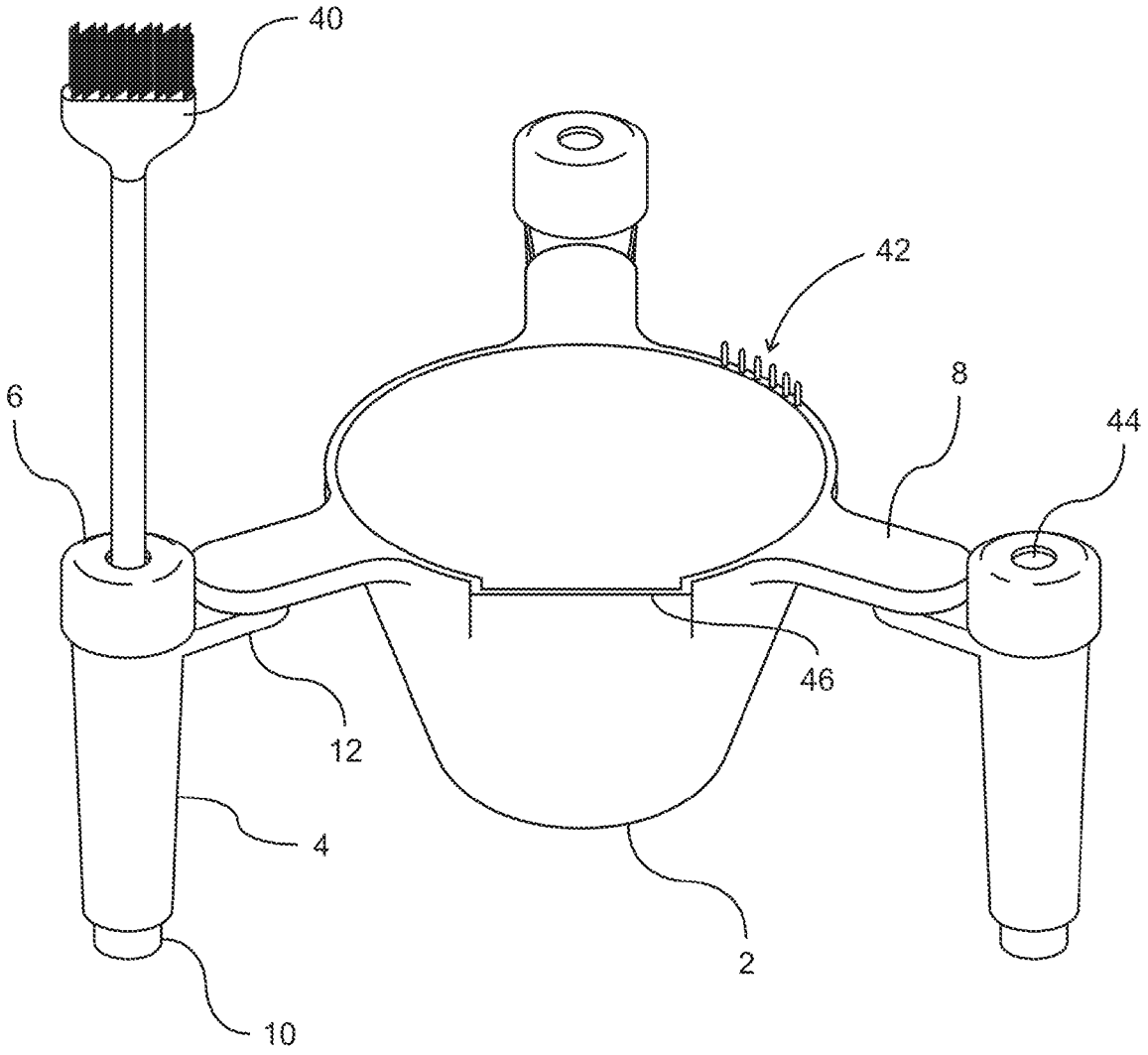
FIG. 14 is a perspective view of an embodiment showing additional features and tools.

FIG. 14, is an embodiment were the support members 4, have a cap 6 that comprises a hole 44. The cap hole 44 can be used to receive a tool. As shown in this figure, cap hole conveniently receives a brush 40. Further, in this embodiment, the bowl has a spout 46 for facilitating discard of liquids such as the dye mixture. Moreover, the bowl 2, may have serration 42 used for scraping or cleaning the brush 40, or another tool. The serration 42, may be located at different positions on the assembly.

Figure 15:
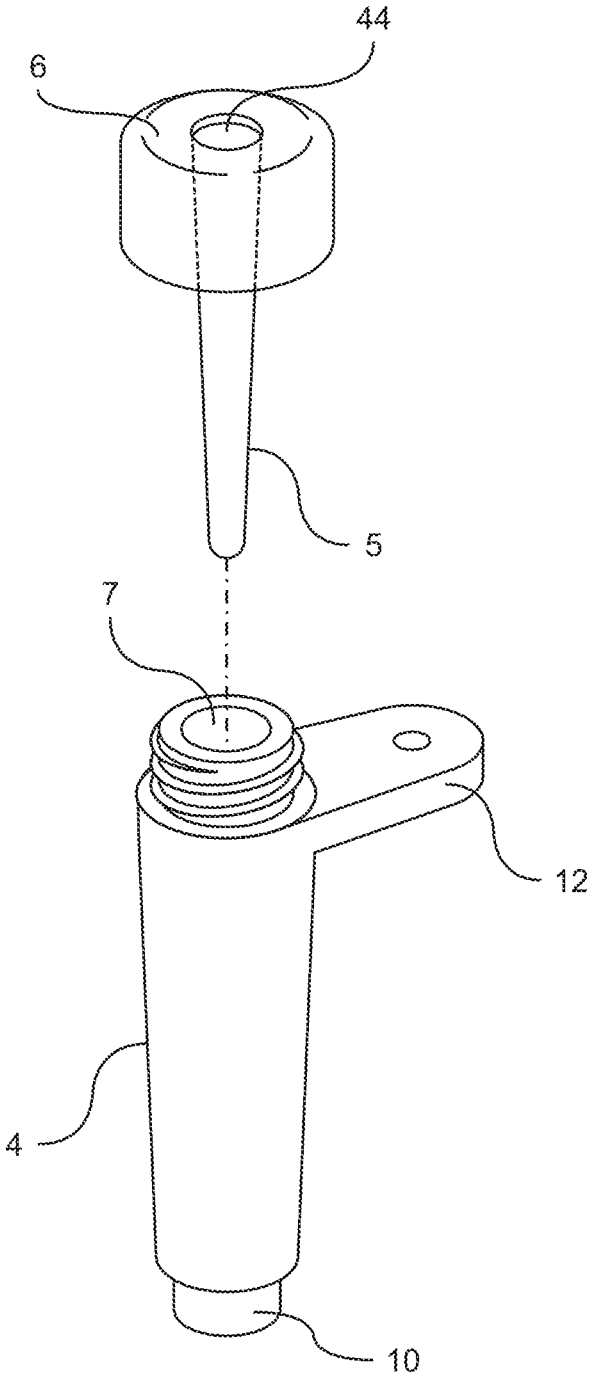
FIG. 15 is a perspective view of an embodiment, showing the arm member with the cap removed to show additional features of the cap.

The cap 6 of in FIG. 15, is removed from the support member 4, to show the hollow stem 5 that extends into the support member 4, through its opening 7. The cap 6 in this embodiment is designed to receive at least a portion of a tool, such as the handle of a brush, through the cap hole 44, and into the hollow stem 5. This support member 4 as in some embodiments comprises a support member arm 12, and a traction pad 10.

Figure 16:
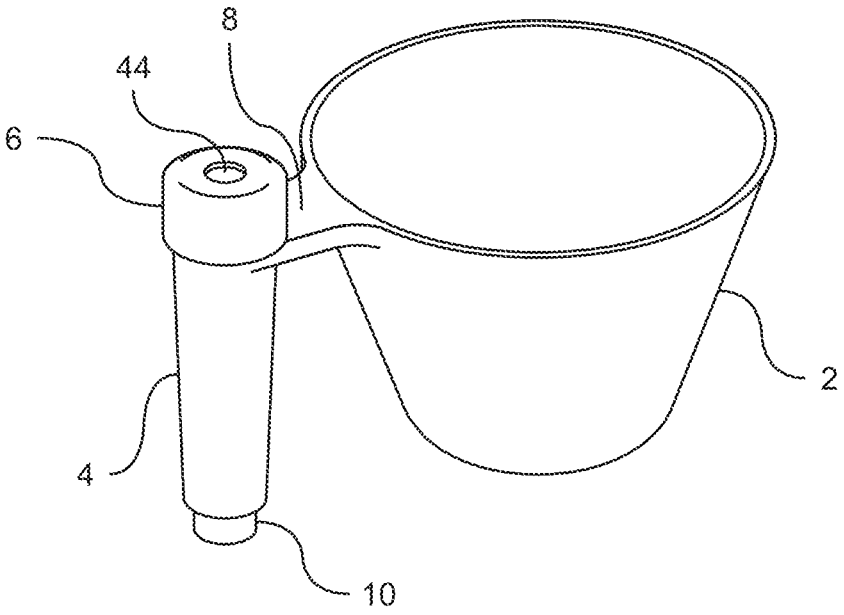
FIG. 16 is a perspective view according to an embodiment showing a bowl with one fixed arm member.
Figure 17:
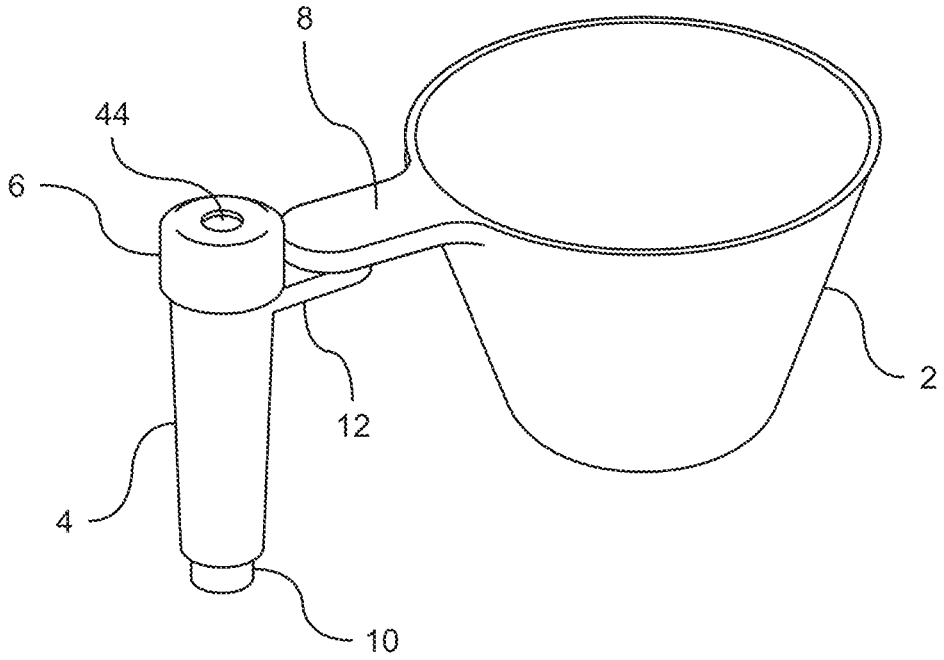
FIG. 17 is a perspective view according to an embodiment showing a bowl with one movable arm member.

Finally, FIGS. 16 and 17, illustrate separate embodiments where the assembly has one support member. In FIG. 16, the support member 4, is immovably fixed to the bowl arm 8, whereas in FIG. 17, the support member 4 is movably connected to the bowl 2, through the support member arm 12, and the bowl arm 8. In both Figures, the support members have a cap 6, with a hole 44 for receiving a tool, along with a traction pads 10 for added stability.

The foregoing description is considered as illustrative only of the principles of the embodiments. Further, since numerous modifications and changes will readily occur to those skilled in the art, the specification and figures be considered as exemplary only, the true scope and spirit of the embodiments being indicated by the following claims.

What is claimed is:

1. A hair dye mixing assembly comprising:

a bowl comprising at least one arm; and at least one support member arranged about said bowl, said at least one support member substantially tubular and comprising a top portion, a bottom portion, and a first opening defined by said top portion; wherein said bowl is attached to said at least one support member through one of said at least one arm;

wherein at least one support member comprises a cap for covering the at least one support member's opening; and, wherein the cap comprises a hole extending downward into a hollow elongated stem adapted to receive and maintain a tool in an upright position.

2. The assembly claim 1, comprising three support members.

3. The assembly of claim 1, wherein at least one support member further comprises an arm.

4. The assembly of claim 3, wherein at least one support member arm is connected to a bowl arm.

5. The assembly of claim 1, wherein at least one support member is immovably fixed to the bowl such that the central longitudinal axis of said support members and central axis of said bowl are substantially parallel.

6. The assembly of claim 1, wherein at least one support member is moveably connected to the bowl.

7. The assembly of claim 6, wherein at least one support member can rotate toward or away from the bowl.

8. The assembly of claim 6, wherein at least one support member can rotate about a radial axis of said bowl.

9. The assembly of claim 1, wherein at least one support member arm is received in sliding engagement by a slot defined by a bowl arm.

10. The assembly of claim 1, wherein at least one support member further comprises a second opening on the bottom portion of said support member and a traction pad partially located within said second opening.

11. The assembly of claim 1, wherein the bowl further comprises a spout.

12. The assembly of claim 1 wherein the bowl further comprises a serrated portion.

* * * * *